US008987990B2

(12) United States Patent
Kameda et al.

(10) Patent No.: US 8,987,990 B2
(45) Date of Patent: Mar. 24, 2015

(54) PLASMA JET SPARK PLUG AND IGNITION SYSTEM

(75) Inventors: Hiroyuki Kameda, Nagakute (JP); Daisuke Nakano, Kiyosu (JP); Naofumi Yamamura, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 682 days.

(21) Appl. No.: 13/396,656

(22) Filed: Feb. 15, 2012

(65) Prior Publication Data

US 2012/0212131 A1 Aug. 23, 2012

(30) Foreign Application Priority Data

Feb. 16, 2011 (JP) ..... 2011-30340
Jan. 17, 2012 (JP) ..... 2012-6656

(51) Int. Cl.
*H01T 13/50* (2006.01)

(52) U.S. Cl.
CPC ..... *H01T 13/50* (2013.01)
USPC ..... 315/71; 315/63; 313/137; 313/141

(58) Field of Classification Search
None
See application file for complete search history.

(56) References Cited

U.S. PATENT DOCUMENTS

| | | | | |
|---|---|---|---|---|
| 7,772,752 | B2 * | 8/2010 | Nakamura et al. | 313/141 |
| 7,843,117 | B2 | 11/2010 | Jaffrezic et al. | 313/145 |
| 8,264,132 | B2 * | 9/2012 | Kameda et al. | 313/141 |
| 8,278,808 | B2 | 10/2012 | Lykowski | 313/141 |
| 2007/0188063 | A1 | 8/2007 | Lykowski | 313/137 |
| 2007/0188064 | A1 | 8/2007 | Lykowski | 313/141 |
| 2009/0033194 | A1 | 2/2009 | Jaffrezic et al. | 313/130 |
| 2011/0254429 | A1 | 10/2011 | Kameda et al. | 313/141 |
| 2013/0065474 | A1 | 3/2013 | Lykowski | 445/7 |

FOREIGN PATENT DOCUMENTS

| | | | |
|---|---|---|---|
| JP | 57-3387 | 1/1982 | H01T 13/20 |
| JP | 2007-280668 | 10/2007 | H01T 13/36 |
| JP | 2008-529229 | 7/2008 | H01T 13/54 |
| JP | 2009/527078 | 7/2009 | H01T 13/20 |
| JP | 2009-193737 | 8/2009 | H01T 13/20 |
| JP | 2010-153330 | 7/2010 | H01T 13/52 |
| JP | 2010-218768 | 9/2010 | H01T 13/52 |

OTHER PUBLICATIONS

Notification of Reasons for Rejection (dated Jul. 2, 2013) issued in connection with corresponding Japanese Patent Application No. 2012-006656, with English translation.

* cited by examiner

*Primary Examiner* — Long Nguyen
(74) *Attorney, Agent, or Firm* — Kusner & Jaffe

(57) ABSTRACT

A plasma jet spark plug having increased capacitive discharge current, and thus improved plasma generation efficiency. The plasma jet spark plug includes an insulating body having an axial hole, a center electrode, a metal shell, and a cavity portion formed by the inner peripheral surface of the insulating body and the leading end face of the center electrode. A conductive layer formed from a conductive material is provided on at least one portion of at least one of: (a) a surface on the insulating body outer peripheral surface opposed to the inner peripheral surface of the metal shell, the conductive layer electrically connected to a ground electrode; and (b) a surface on the insulating body inner peripheral surface opposed to the outer peripheral surface of the center electrode, the conductive layer electrically connected to the center electrode.

9 Claims, 12 Drawing Sheets

PLASMA JET SPARK PLUG AND IGNITION SYSTEM

FIELD OF THE INVENTION

The present invention relates to a plasma jet spark plug which carries out an ignition of a mixture by generating plasma, and an ignition system including the plasma jet spark plug.

BACKGROUND OF THE INVENTION

Heretofore, a spark plug which ignites a mixture using a spark discharge has been used in a combustion device such as an internal combustion engine. Also, in recent years, in order to comply with a demand for higher power and lower fuel consumption in the combustion device, a plasma jet spark plug has been proposed as a spark plug with which it is also possible to more reliably ignite a lean mixture with a fast-spreading combustion and a higher ignition limit air/fuel ratio.

In general, a plasma jet spark plug includes a hollow cylindrical insulating body having an axial hole, a center electrode inserted into the axial hole in a condition in which the leading end face of the center electrode is withdrawn below the leading end face of the insulating body, a metal shell disposed on the outer periphery of the insulating body, and an annular ground electrode joined to a leading end portion of the metal shell. Also, the plasma jet spark plug has a space (a cavity portion) formed by the leading end face of the center electrode and the inner peripheral surface of the axial hole, wherein the cavity portion is caused to communicate with the exterior via a through hole formed in the ground electrode. For example, refer to JP-A-2010-218768 (Patent Document 1).

With this kind of plasma jet spark plug, an ignition of a mixture is carried out in the following way. Firstly, a voltage is applied to a gap formed between the center electrode and ground electrode, thereby causing a spark discharge in the gap. After that, a gas in the cavity portion is plasmanized by supplying power to the gap, generating plasma inside the cavity portion. Then, the generated plasma is emitted from an opening of the cavity portion, thereby carrying out an ignition of a mixture.

SUMMARY OF THE INVENTION

Problems to be Solved by the Invention

In order to promote a plasmanization of a gas and enhance plasma generation efficiency (ignitability), it is vital, on discharging a spark, to increase current (capacitive discharge current) flowing as a result of a capacitive discharge wherein a voltage fluctuates rapidly. However, when generating plasma, an inductive discharge, wherein a minute current keeps flowing following a capacitive discharge, may occur when discharging a spark by applying a voltage. That is, energy for the inductive discharge is wasted, and there is a danger that energy efficiency decreases.

Therefore, a technique can be considered whereby the shape of a spark plug is changed to increase the capacitance of the spark plug, or a capacitor is provided outside the spark plug, thereby changing energy heretofore used for an inductive discharge to energy used for a capacitive discharge, thus increasing capacitive discharge current. However, in the former case, a need to drastically change the shape of the spark plug arises in order to increase the capacitance, and a problem occurs in terms of practicality when considering the standards of a spark plug, an internal combustion engine, and the like. Also, in the latter case, a high-capacity capacitor with superior withstand voltage is required, and there is a danger that it leads to an increase in manufacturing costs and an increase in the size of a device.

The invention, having been contrived bearing in mind the heretofore described circumstances, has an object of providing a plasma jet spark plug and an ignition system with which it is possible to increase capacitive discharge current and improve plasma generation efficiency without drastically changing the size of a spark plug or providing a capacitor outside.

Means for Solving the Problems

Hereafter, an itemized description will be given of each configuration suitable for achieving the object. Working effects specific to the corresponding configurations are quoted as necessary.

Configuration 1. In this configuration, a plasma jet spark plug includes:

an insulating body having an axial hole extending in a direction of an axis;

a center electrode inserted on a leading end side of the axial hole so that a leading end face of the center electrode is positioned closer to a rear end side of the spark plug in the axis direction than a leading end of the insulating body;

a metal shell disposed on an outer periphery of the insulating body, a ground electrode, fixed in a leading end portion of the metal shell, which is disposed closer to a leading end side of the spark plug in the axis direction than the leading end of the insulating body, a cavity portion formed by an inner peripheral surface of the insulating body and the leading end face of the center electrode, at least one conductive layer formed from a conductive material provided on at least one portion of at least one of (a) a part of an outer peripheral surface of the insulating body which is opposed to an inner peripheral surface of the metal shell, the conductive layer electrically connected to the ground electrode and (b) a part of the inner peripheral surface of the insulating body which is opposed to an outer peripheral surface of the center electrode, the conductive layer electrically connected to the center electrode.

The capacitance of the spark plug is determined mainly by the capacitance of a charge accumulation region (i.e., a region functioning as a capacitor) formed by an energizing member (the center electrode or the like) disposed in the axial hole, the metal shell, and the insulating body sandwiched between them. Also, bearing in mind the securing of ease of mounting, or the like, in general, an annular clearance is formed between the outer peripheral surface of the insulating body and the inner peripheral surface of the metal shell, or between the outer peripheral surface of the center electrode and the inner peripheral surface of the insulating body. That is, it is common that the charge accumulation region is configured having the clearance (an airspace) interposed therein.

Bearing in mind this point, according to the configuration 1, a conductive layer formed from a conductive material is provided on at least one portion of at least one of a surface on the insulating body outer peripheral surface opposed to the inner peripheral surface of the metal shell and a surface on the insulating body inner peripheral surface opposed to the outer peripheral surface of the center electrode. Then, when providing a conductive layer on the outer peripheral surface of the insulating body, the conductive layer (first conductive layer) is electrically connected to the ground electrode and thus the metal shell while, when providing a conductive layer on the inner peripheral surface of the insulating body, the conductive layer (second conductive layer) is electrically connected to the center electrode.

That is, by providing the first conductive layer, the charge accumulation region is formed by the first conductive layer provided on the outer peripheral surface of the insulating body, an energizing member such as the center electrode (when providing the second conductive layer, the second conductive layer), and the insulating body sandwiched between them. Consequently, when the first conductive layer is provided, the charge accumulation region is such that the annular clearance formed between the outer peripheral surface of the insulating body and the inner peripheral surface of the metal shell is not interposed therein. Also, by providing the second conductive layer, the charge accumulation region is formed by the second conductive layer provided on the inner peripheral surface of the insulating body, the metal shell (when providing the first conductive layer, the first conductive layer), and the insulating body sandwiched between them. Consequently, when the second conductive layer is provided, the charge accumulation region is such that the annular clearance formed between the outer peripheral surface of the center electrode and the inner peripheral surface of the insulating body is not interposed therein.

By configuring in such a way that no clearance is interposed in the charge accumulation region in this way, it is possible to dramatically increase the capacitance of the charge accumulation region and thus the spark plug, and it is possible to accumulate a larger amount of electrical charge in the spark plug. As a result of this, it is possible to increase capacitive discharge current, and it is possible to improve plasma generation efficiency.

Also, as there is no need to provide a capacitor outside, it is possible to prevent an increase in manufacturing costs and an increase in the size of a device. Furthermore, as it is possible to achieve an increase in capacitance simply by providing a conductive layer on the outer peripheral surface or inner peripheral surface of the insulating body, the spark plug comes to have the same shape as a heretofore known spark plug in appearance, and no problem will arise in terms of practicability.

A technology is proposed whereby a conductive layer is provided on the inner peripheral surface or outer peripheral surface of the insulating body (for example, JP-A-2007-280668), but the technology is such that a discharge between the insulating body and the center electrode or metal shell is suppressed by making the potential of the inner peripheral surface or outer peripheral surface of the insulating body approximately equal to the potential of the center electrode or metal shell, thus preventing damage to the insulating body. As opposed to this, the invention is such that, bearing in mind that it is effective to increase capacitive discharge current in order to improve plasma generation efficiency in the plasma jet spark plug, the capacitance of the spark plug is increased by providing a conductive layer on the inner peripheral surface or outer peripheral surface of the insulating body, thus increasing capacitive discharge current. Consequently, the invention and the heretofore described related art are greatly different in technical problems and actions, and differ in technical ideas.

Configuration 2. In this configuration, the plasma jet spark plug according to the configuration 1 is characterized in that the insulating body includes:

a shoulder retained directly or indirectly on the inner peripheral surface of the metal shell; and an insulator nose length portion extending from the leading end of the shoulder to the axis direction leading end side, wherein the conductive layer is provided on at least one portion of the outer peripheral surface of the insulator nose length portion.

In general, the insulator nose length portion is configured in such a way that the outside diameter thereof is smaller than the outside diameters of the other portions of the insulating body, and the thickness of the insulator nose length portion is smaller than the thicknesses of the other portions of the insulating body.

Bearing in mind this point, according to the configuration 2, the conductive layer is provided on at least one portion of the outer peripheral surface of the insulator nose length portion. Consequently, the charge accumulation region is formed in a condition in which the distance between the conductive layer and energizing member (center electrode or the like) is sufficiently small, and it is possible to still further increase the capacitance of the charge accumulation region and thus the spark plug. Also, as the charge accumulation region is formed extremely near a gap (a portion in which a capacitive discharge is caused) formed between the center electrode and ground electrode, it is possible to make an energizing path from the charge accumulation region to the gap extremely short, and it is possible to effectively suppress a power loss when current flows from the charge accumulation region to the gap. Consequently, by these working effects acting synergistically, it is possible to further improve plasma generation efficiency, and it is possible to achieve a further improvement in ignitability.

A spark plug which ignites using a spark discharge is configured in such a way that the leading end of the center electrode protrudes from the leading end of the insulating body. Consequently, as there is a possibility that an abnormal discharge (so-called inward flying sparks or transverse flying sparks) creeping along the outer peripheral surface of the insulator nose length portion occurs between the center electrode and metal shell, no conductive layer can be provided on the leading end side of the insulator nose length portion, in order to prevent the abnormal discharge. As opposed to this, with the plasma jet spark plug, as a discharge occurs between the center electrode and ground electrode in the cavity portion, it does not happen that the abnormal discharge occurs even in the event that a conductive layer electrically connected to the ground electrode is provided all over the outer peripheral surface of the insulator nose length portion. Consequently, it is possible to provide a conductive layer in a wide area of the insulator nose length portion without considering an occurrence of the abnormal discharge, and it is possible to hope for a further increase in capacitance by providing a conductive layer in a wide area of the insulator nose length portion.

Configuration 3. In this configuration, the plasma jet spark plug according to the configuration 1 or 2 is characterized in that the insulating body includes a protuberance retained directly or indirectly on the inner peripheral surface of the metal shell, and the metal shell includes:

amounting threaded portion formed on the leading end side outer periphery thereof; and a seat, formed closer to the rear end side than the threaded portion, which extends outward in a radial direction, wherein the conductive layer is provided in at least one portion of a region of the insulating body outer peripheral surface closer to the leading end side than the protuberance, and the protuberance is positioned closer to the axis direction rear end side than the leading end side end face of the seat.

In a common spark plug, a protuberance of the insulating body is provided closer to the leading end side than the seat of the metal shell. As opposed to this, according to the configuration 3, a configuration is adopted such that the protuberance is positioned closer to the rear end side than the seat. Because of this, it is possible to further increase the length of a region of the insulating body positioned closer to the leading end side than the protuberance, and it is thus possible to further increase the length of the conductive layer provided on the outer peripheral surface of the insulating body. Because of this, as well as it being possible to increase the area of the conductive layer, it is possible to limit the interposition of the clearance in the charge accumulation region over a wider area, and it is thus possible to further increase the capacitance of the spark plug. As a result of this, it is possible to achieve a further improvement in plasma generation efficiency, and it is possible to further improve ignitability.

Configuration 4. In this configuration, the plasma jet spark plug according to any one of the configurations 1 to 3 is characterized in that a conductive energizing portion connected to the rear end portion of the center electrode is inserted in the axial hole, and a resistor is disposed in a region of the energizing portion closer to the axis direction rear end side than the conductive layers.

When providing a capacitor outside the spark plug, it is not possible to provide the resistor in the energizing portion of the spark plug interposed between the center electrode and external capacitor, in order to supply power from the external capacitor to the gap between the center electrode and ground electrode with as little loss as possible. However, when not providing the resistor, noise (radio noise) becomes larger when energizing, and there is a danger that, for example, it affects a control system device or the like.

In this regard, according to the configuration 4, as the resistor is provided closer to the axis direction rear end side than the conductive layers (that is, the charge accumulation region), a configuration is adopted such that the resistor does not exist on a power transmission path from the charge accumulation region to the gap. Consequently, it is possible to prevent a power loss due to the existence of the resistor when current flows from the charge accumulation region to the gap while achieving the effectiveness of suppression of noise owing to providing the resistor, and it is possible to more reliably achieve the working effect of an improvement in plasma generation efficiency according to the configuration 1.

Configuration 5. In this configuration, the plasma jet spark plug according to the configuration 4 is characterized in that an electrical resistance value between the rear end of the energizing portion and the leading end of the center electrode via the resistor is set to 1 kΩ or more and 10 kΩ or less.

According to the configuration 5, as the electrical resistance value between the rear end of the energizing portion and the leading end of the center electrode via the resistor is set to 1 kΩ or more, it is possible to make the effectiveness of suppression of noise greater.

Meanwhile, as the electrical resistance value is set to 10 kΩ or less, it is possible to effectively suppress a power loss when power is transmitted from a power supply to the spark plug (charge accumulation region). As a result of this, it is possible to more reliably increase capacitive discharge current.

Configuration 6. In this configuration, the plasma jet spark plug according to any one of the configurations 1 to 5 is characterized in that the outer peripheral surface of the insulating body is exposed in an area from the leading end of the center electrode to a position 1 mm toward the rear end along the axis.

When a conductive layer electrically connected to the ground electrode is formed on a surface on the insulating body outer peripheral surface positioned on an outer circumference side of the leading end of the center electrode, there is a danger that, when a spark discharge occurs between the center electrode and ground electrode, the spark discharge occurs in a condition in which it is excessively pressed toward the outer circumference side. As a result of this, there is a danger that a phenomenon (a so-called channeling) wherein the insulating body is cut due to a spark discharge progresses rapidly, leading to a rapid increase in the volume of the cavity portion and thus a rapid decrease in ignitability.

In this regard, according to the configuration 6, a configuration is adopted such that the outer peripheral surface of the insulating body is exposed (that is, no conductive layer exists on the outer peripheral surface of the insulating body) in an area from the leading end of the insulating body to a position 1 mm toward the rear end from the leading end of the center electrode. Consequently, it is possible to effectively prevent a situation in which a spark discharge occurs in a condition in which it is excessively pressed toward the outer circumference side, and it is possible to more reliably prevent a rapid progress of a channeling. As a result of this, it is possible to more reliably prevent a rapid increase in the volume of the cavity portion, and it is thus possible to maintain superior ignitability over a long period.

Configuration 7. In this configuration, the plasma jet spark plug according to any one of the configurations 1 to 6 is characterized in that the capacitance thereof is set to 25 pF or more and 100 pF or less.

According to the configuration 7, the capacitance of the spark plug is sufficiently high at 25 pF or more. Consequently, it is possible to more reliably increase capacitive discharge current, and it is possible to further improve plasma generation efficiency.

Meanwhile, it is possible to hope for an improvement in ignitability by increasing the capacitance in the way heretofore described, but when the capacitance is excessively increased, discharge energy when discharging a spark increases enormously, and there is a danger that a channeling progresses rapidly.

Bearing in mind this point, according to the configuration 7, the capacitance of the spark plug is set to 100 pF or less. Consequently, it is possible to effectively suppress an occurrence of a channeling, and it is thus possible to maintain superior ignitability over a long period.

Configuration 8. In this configuration, the plasma jet spark plug according to any one of the configurations 1 to 7 is characterized in that the center electrode includes a flange portion, protruding outward in the radial direction, which is retained on the inner peripheral surface of the insulating body, and the metal shell includes a retained portion by which the outer peripheral surface of the insulating body is retained directly or indirectly, wherein the conductive layer is provided in at least one portion of a region of the insulating body inner peripheral surface positioned closer to the leading end side of the spark plug than the flange portion, and the flange portion is positioned closer to the rear end side of the spark plug in the axis direction than the retained portion.

According to the configuration 8, it is possible to further increase the length of a region on the axial hole positioned closer to the leading end side than the flange portion. Consequently, it is possible to secure a larger length of the conductive layer provided on the inner peripheral surface of the insulating body, and it is possible to further increase the capacitance of the spark plug. As a result of this, it is possible to even further improve ignitability.

Configuration 9. In this configuration, an ignition system includes:

the plasma jet spark plug according to the configuration 4; and a voltage application unit which applies a voltage via the energizing portion to a gap formed between the center electrode and ground electrode.

According to the configuration 9, basically, working effects the same as those of the configuration 4 are achieved.

DETAILED DESCRIPTION OF THE INVENTION

Figure 1:
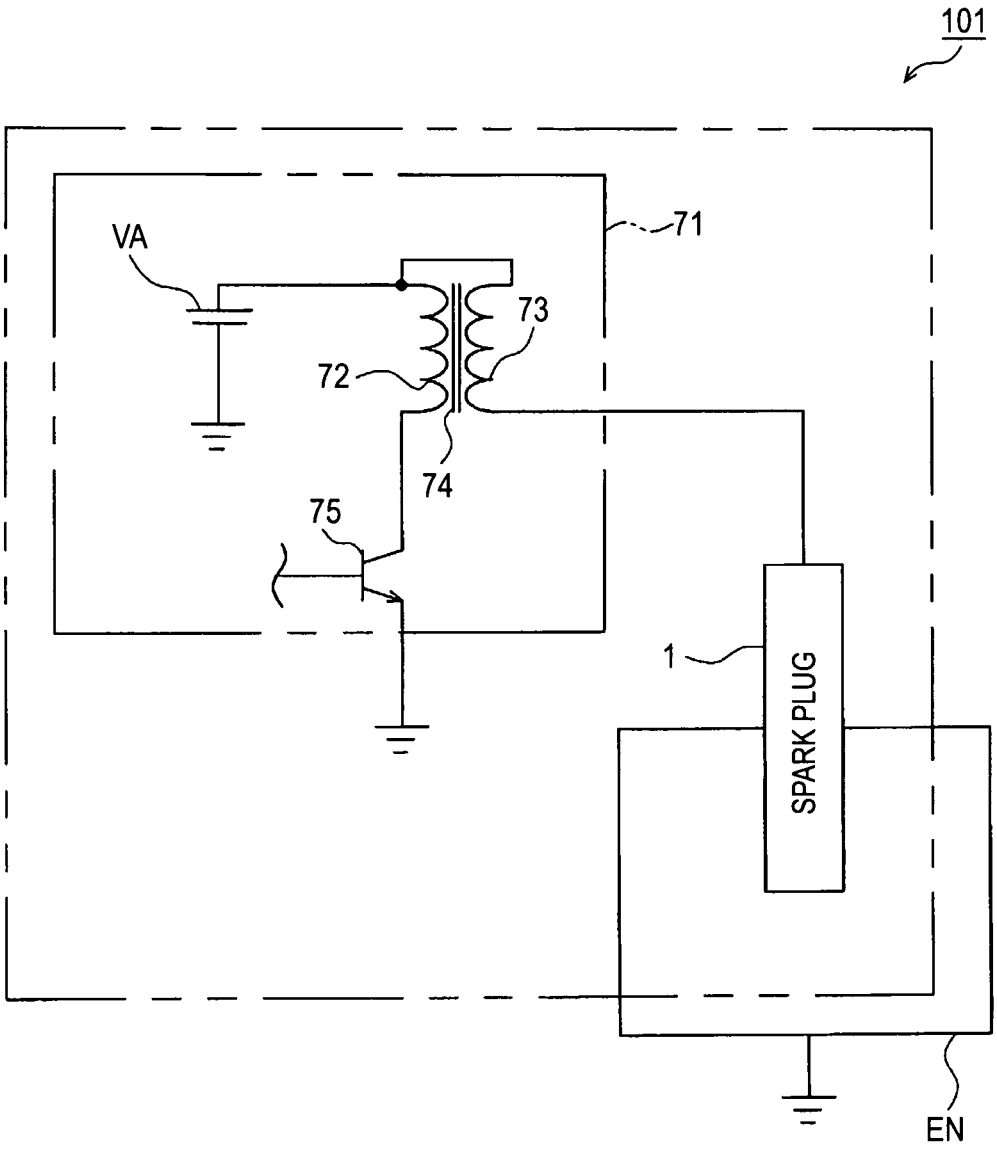
FIG. 1 is a block diagram showing an outline configuration of a spark plug.

Hereafter, a description will be given of one embodiment, while referring to the drawings. FIG. 1 is a block diagram showing an outline configuration of an ignition system 101 having a plasma jet spark plug (hereafter called a "spark plug") 1 and a voltage application unit 71. Only one spark plug 1 is shown in FIG. 1, but plural cylinders are provided in an internal combustion engine EN, and the spark plug 1 is provided corresponding to each cylinder. Then, the voltage application unit 71 is provided for each spark plug 1.

Figure 2:
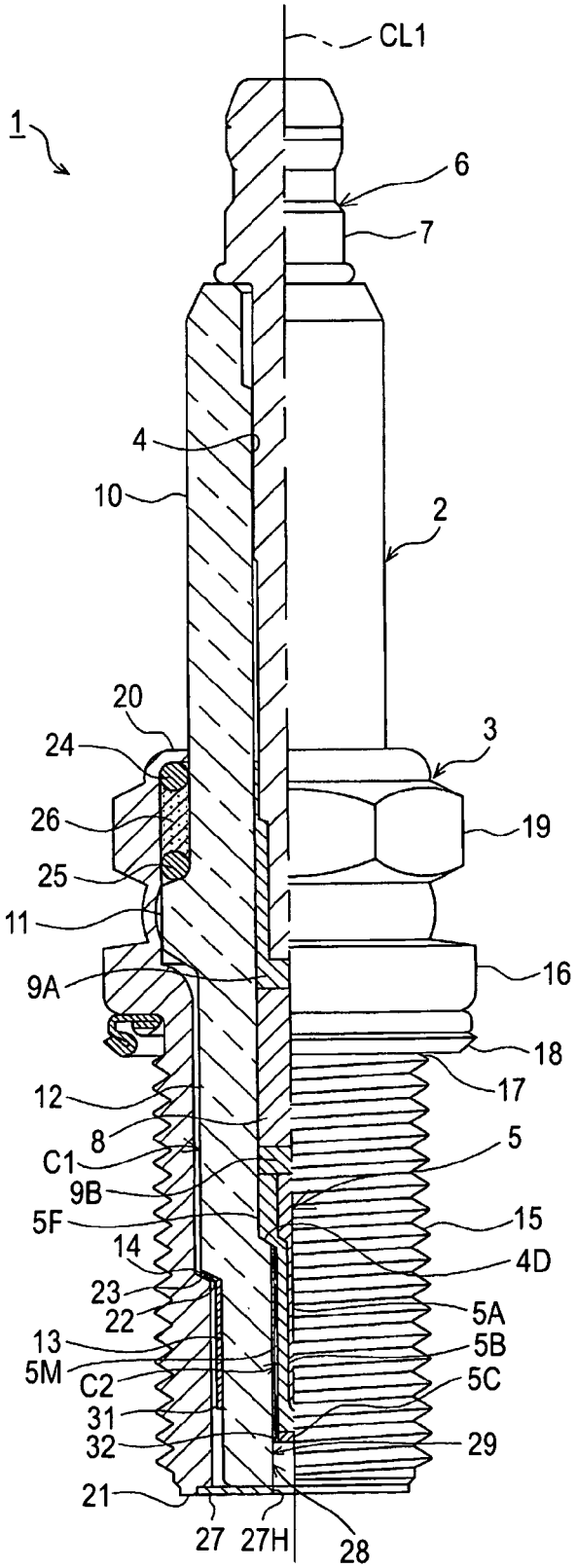
FIG. 2 is a partially sectioned front view showing a configuration of the spark plug.

Prior to a description of the ignition system 101, a description will be given, referring to FIG. 2 and the like, of a configuration of the spark plug 1. FIG. 2 is a partially sectioned front view showing the spark plug 1. In FIG. 2, a description will be given with a direction of an axis CL1 of the spark plug 1 as an up-down direction in the drawing, the lower side as the leading end side of the spark plug 1, and the upper side as the rear end side.

The spark plug 1 is configured of a hollow cylindrical insulator 2 acting as an insulating body, a hollow cylindrical metal shell 3 which holds the insulator 2, and the like.

The insulator 2, being formed by sintering alumina or the like, as is well known, includes in the external portion thereof a rear end side barrel portion 10 formed on the rear end side, a large diameter portion 11 formed closer to the leading end side than the rear end side barrel portion 10 so as to protrude outward in a radial direction, a middle barrel portion 12 formed closer to the leading end side than the large diameter portion 11 so as to be smaller in diameter than the large diameter portion 11, and an insulator nose length portion 13 formed closer to the leading end side than the middle barrel portion 12 so as to be smaller in diameter than the middle barrel portion 12. In addition, the large diameter portion 11, middle barrel portion 12, and insulator nose length portion 13 of the insulator 2 are housed inside the metal shell 3. Also, a tapered decreasing diameter portion 14 acting as a shoulder is formed at the junction of the middle barrel portion 12 and insulator nose length portion 13, and the insulator 2 is retained on the metal shell 3 by the decreasing diameter portion 14.

In the embodiment, a configuration is adopted such that the inside diameter of the metal shell 3 is larger than the outside diameter of the insulator 2 between the rear end of the middle barrel portion 12 and the leading end of the insulator nose length portion 13. Because of this, an annular clearance C1 is formed between the outer peripheral surface of the insulator 2 and the inner peripheral surface of the metal shell 3 from the rear end of the middle barrel portion 12 to the leading end of the insulator nose length portion 13. Also, the outside diameter of the insulator nose length portion 13 is made smaller than the outside diameters of the other regions (the large diameter portion 11, middle barrel portion 12, and the like) of the insulator 2, as a result of which the thickness of the insulator nose length portion 13 is made smaller than the thicknesses of the other regions of the insulator 2.

In addition, an axial hole 4 is formed in the insulator 2 along the axis CL1 so as to pass through the insulator 2, and a center electrode 5 is inserted and fixed on the leading end side of the axial hole 4. Specifically, the center electrode 5, including a flange portion 5F formed on the rear end side of the center electrode 5 so as to protrude outward in a radial direction, and a cylindrical main body portion 5M, extending from the flange portion 5F to the leading end side, which has approximately the same outside diameter, is fixed on the leading end side of the axial hole 4 by the flange portion 5F being retained by a shoulder 4D formed on the axial hole 4. Also, the center electrode 5 is such that the leading end thereof is disposed closer to the axis CL1 direction rear end side than the leading end face of the insulator 2. In order to enable the center electrode 5 to be easily inserted into the axial hole 4, the outside diameter of the main body portion 5M is made slightly smaller than the inside diameter of a region of the axial hole 4 into which the main body portion 5M is inserted, and an annular clearance C2 is formed between the outer peripheral surface of the main body portion 5M and the inner peripheral surface of the insulator 2.

Furthermore, the center electrode 5 includes an inner layer 5A formed from copper, a copper alloy, or the like, with superior thermal conductivity and an outer layer 5B formed from a nickel (Ni)-based Ni alloy [for example, Inconel (registered trademark) 600 or 601]. In addition, an electrode tip 5C formed from tungsten (W), iridium (Ir), platinum (Pt), nickel (Ni), or an alloy with at least one kind, among these metals, as a primary component is provided in a region of the center electrode 5 up to at least 0.3 mm to the axis CL1 direction rear end side from the leading end of the center electrode 5.

Also, a conductive energizing portion 6 connected to the rear end portion of the center electrode 5 is inserted in the axial hole 4, and a high voltage is applied to the center electrode 5 via the energizing portion 6. In the embodiment, the energizing portion 6 includes a terminal electrode 7, a resistor 8, and glass seal layers 9A and 9B, each of which has conductivity.

Figure 3:
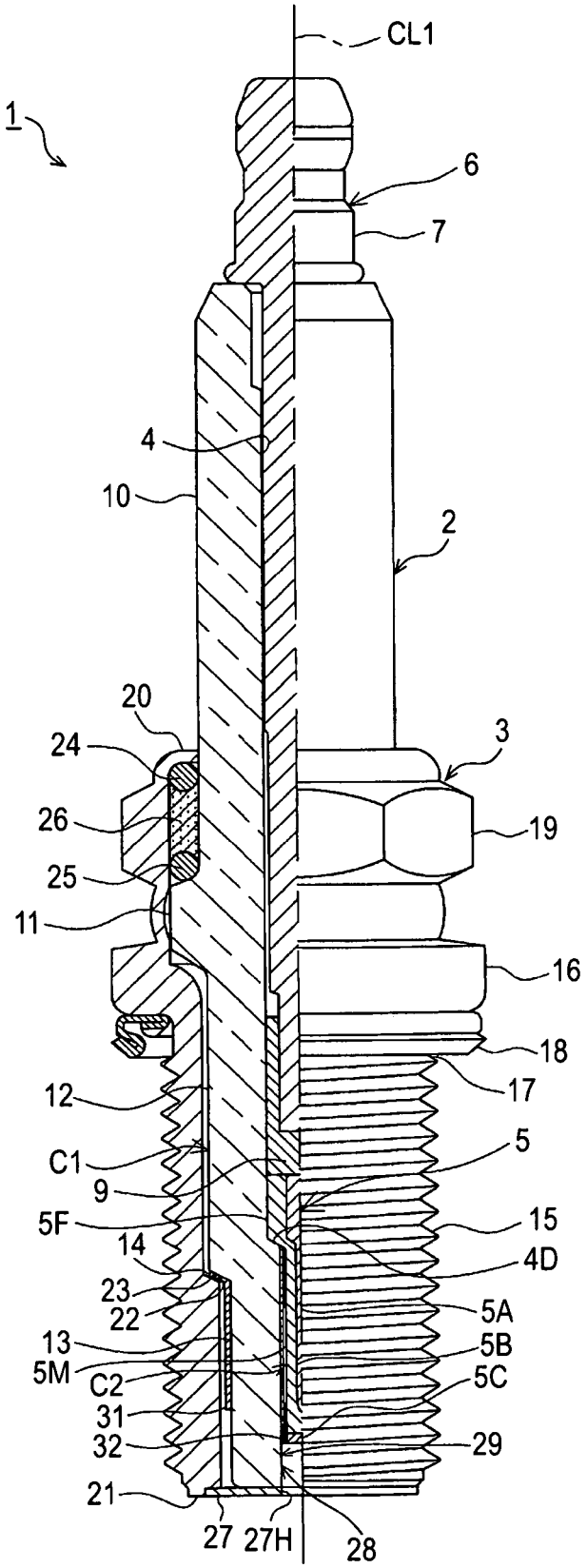
FIG. 3 is a partially sectioned front view showing another example of the spark plug.

The terminal electrode 7 is inserted and fixed in the axial hole 4 in a condition in which the rear end portion of the terminal electrode 7 protrudes from the rear end of the insulator 2. The resistor 8, forming a cylindrical shape, is disposed between the center electrode 5 and terminal electrode 7 in the axial hole 4. The resistor 8 is formed by a conductive material (for example, carbon black) or a composition of glass powder and the like being heated and sealed, and in the embodiment, the resistance value of the resistor 8 is set so that the electrical resistance value between the rear end of the energizing portion 6 and the leading end of the center electrode 5 via the resistor 8 is 1 kΩ or more and 10 kΩ or less. In addition, the glass seal layers 9A and 9B are disposed between the center electrode 5 and terminal electrode 7 in such a way as to sandwich the resistor 8, and the center electrode 5 and terminal electrode 7 are electrically connected via the resistor 8 and glass seal layers 9A and 9B. The center electrode 5 and terminal electrode 7 may be electrically connected via a glass seal layer 9 without providing the resistor 8, as shown in FIG. 3.

Returning to FIG. 2, the metal shell 3 is formed in a hollow cylindrical shape from a metal such as a low carbon steel, and a threaded portion (an externally threaded portion) 15 for mounting the spark plug 1 in a mounting hole of a combustion device (for example, an internal combustion engine or a fuel cell reformer) is formed on the outer peripheral surface of the metal shell 3. Also, a seat 16 bulging outward in the radial direction is formed on the outer peripheral surface on the rear end side of the threaded portion 15, and a ring-like gasket 18 is fitted around a thread neck 17 at the rear end of the threaded portion 15. Furthermore, a tool engagement portion 19 of hexagonal cross section for engaging a tool such as a wrench when mounting the metal shell 3 in the combustion device is provided, as well as a caulked portion 20 for holding the insulator 2 at the rear end portion of the metal shell 3 being provided, on the rear end side of the metal shell 3. Moreover, an annular fitting portion 21 formed so as to protrude toward the axis CL1 direction leading end side is formed on the rim of the leading end portion of the metal shell 3, and a ground electrode 27, to be described hereafter, is fitted within the fitting portion 21. With the spark plug 1 mounted in the combustion device, the metal shell 3 and thus the ground electrode 27 jointed thereto are grounded.

Also, a tapered portion 22 acting as a retained portion for retaining the insulator 2 is provided on the inner peripheral surface of the metal shell 3. Then, the insulator 2 is inserted from the rear end side toward the leading end side of the metal shell 3, and fixed to the metal shell 3 by caulking the rear end side opening portion of the metal shell 3 inward in the radial direction, that is, forming the caulked portion 20, in a condition in which the decreasing diameter portion 14 of the insulator 2 is retained by the tapered portion 22 of the metal shell 3. An annular plate packing 23 is interposed between the decreasing diameter portion 14 of the insulator 2 and the tapered portion 22 of the metal shell 3. Because of this, the interior of a combustion chamber is maintained airtight, thus preventing a fuel gas infiltrating into a clearance between the insulator 2 nose length portion 13 and metal shell 3 inner peripheral surface from leaking to the exterior. Also, in the embodiment, as the flange portion 5F is positioned closer to the axis CL1 direction rear end side than the tapered portion 22, a configuration is adopted such that a length of the main body portion 5M along the axis CL1 is comparatively large.

Furthermore, in order to make a caulking seal more complete, annular ring members 24 and 25 are interposed between the metal shell 3 and insulator 2 on the rear end side of the metal shell 3, and a space between the ring members 24 and 25 is filled with talc 26 powder. That is, the metal shell 3 holds the insulator 2 across the plate packing 23, ring members 24 and 25, and talc 26.

Also, the disk-like ground electrode 27 is joined to the leading end portion of the metal shell 3 so as to be positioned closer to the axis CL1 direction leading end side than the leading end of the insulator 2. Specifically, the ground electrode 27 is joined to the metal shell 3 by the outer circumferential portion thereof being welded to the fitting portion 21 in a condition in which it is fitted within the fitting portion 21. Also, a gap 29 is formed between the center electrode 5 and ground electrode 27, and a spark discharge occurs in the gap 29 owing to a high voltage being applied to the center electrode 5. In the embodiment, the ground electrode 27 is configured from W, Ir, Pt, Ni, or an alloy with at least one kind, among these metals, as a primary component.

In addition, the ground electrode 27 has in the center thereof a through hole 27H passing through in a thickness direction. Then, a cavity portion 28 formed by the inner peripheral surface of the insulator 2 and the leading end face of the center electrode 5, which is a cylindrical space opening toward the leading end side, is in communication with the exterior via the through hole 27H.

Figure 4:
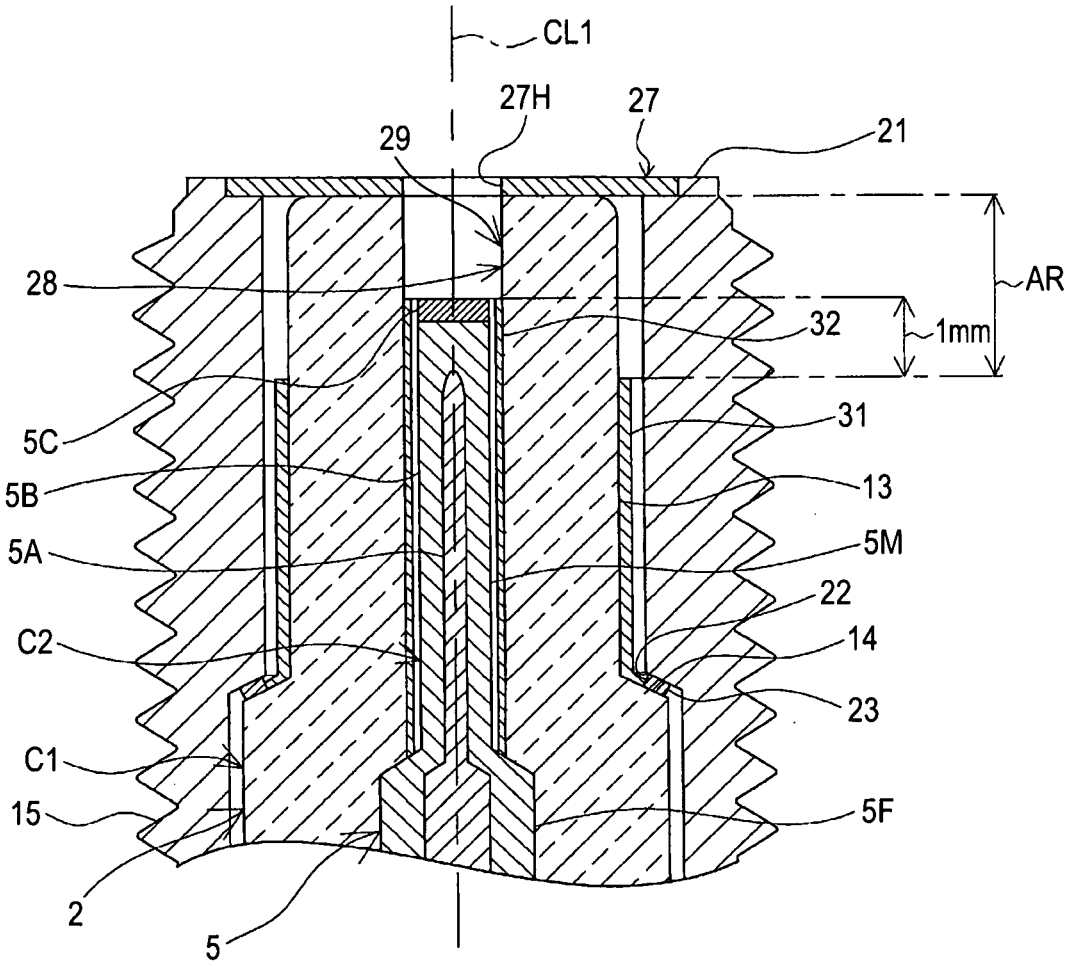
FIG. 4 is a partially enlarged sectional view showing a configuration of a leading end portion of the spark plug.

Furthermore, an annular conductive layer 31 (corresponding to a "first conductive layer") formed from a conductive material (for example, Pt, Ag, or Ni) is provided on a surface on the insulator 2 outer peripheral surface opposed to the inner peripheral surface of the metal shell 3, and an annular conductive layer 32 (corresponding to a "second conductive layer") formed from a conductive material is provided on a surface on the insulator 2 inner peripheral surface opposed to the outer peripheral surface of the center electrode 5. In the embodiment, as shown in FIG. 4 (in FIG. 4 and the like, for simplicity of illustration, the conductive layers 31 and 32 are shown thicker than they really are), the conductive layer 31 is provided on the outer peripheral surface of the insulator nose length portion 13, and the conductive layer 32 is provided on a surface on the insulator 2 inner peripheral surface opposed to a region of the center electrode 5 from the leading end side of the flange portion 5F to the leading end of the main body portion 5M. That is, the conductive layers 31 and 32 are provided so as to be opposed to each other in a position closer to the axis CL1 direction leading end side than the resistor 8. The conductive layers 31 and 32 can be obtained by, for example, after a conductive material has been made into paste, applying it to the insulator 2.

Also, the conductive layer 31, the rear end portion of which is in contact with the plate packing 23, is electrically connected to the ground electrode 27 via the plate packing 23 and metal shell 3 (that is, the conductive layer 31 comes into a grounded condition when the spark plug 1 is mounted in the combustion device). Meanwhile, the conductive layer 32, the rear end portion of which is in contact with the center electrode 5, is electrically connected to the center electrode 5 to which a high voltage is applied. Consequently, a charge accumulation region (so to say, a capacitor) in a condition in which the clearances C1 and C2 are not interposed is formed by the two conductive layers 31 and 32 and the insulator 2 (insulator nose length portion 13) sandwiched between them. Also, a charge accumulation region in a condition in which the clearance C2 is not interposed is formed by the conductive layer 32, the metal shell 3, and the insulator 2 sandwiched between them.

Also, by the charge accumulation region in a condition in which the clearance C1 or the like is not interposed being formed in this way, the capacitance of the spark plug 1 is comparatively high, and in the embodiment, it is set to 25 pF or more. By adjusting the range of formation of the conductive layers 31 and 32, the thickness of the insulator 2, the formation material of the insulator 2, and the like, the capacitance of the spark plug 1 is adjusted so as not to be excessively high, and in the embodiment, it is adjusted to 100 pF or less.

The capacitance of the spark plug 1 can generally be obtained by a technique of measuring the capacitance value between the terminal electrode 7 and ground electrode 27, but the capacitance value of a region of the spark plug 1 closer to the leading end side than the resistor 8 (for example, the capacitance value between the center electrode 5 and ground electrode 27) may be measured as the capacitance of the spark plug 1. This is because electrical charge accumulated in the region of the spark plug 1 closer to the leading end side than the resistor 8, as it is supplied between the two electrodes 5 and 27 without going through the resistor 8, acts particularly effectively in order to realize the working effect of the invention of increasing capacitive discharge current and improving plasma generation efficiency.

Also, in the embodiment, as the outer peripheral surface of the insulator 2 is not covered with the conductive layer 31 in an area AR from the leading end of the insulator 2 to a position 1 mm toward the rear end along the axis CL1 from the leading end of the center electrode 5, the insulator 2 is configured in such a way that the outer peripheral surface thereof is exposed in the area AR.

Next, a description will be given of the voltage application unit 71 which applies a voltage to the heretofore described spark plug 1.

As shown in FIG. 1, the voltage application unit 71 includes a primary coil 72, a secondary coil 73, a core 74, and an igniter 75.

The primary coil 72 is wound around the core 74, and one end of the primary coil 72 is connected to a power supply battery VA, while the other end thereof is connected to the igniter 75. Also, the secondary coil 73 is wound around the core 74, and one end of the secondary coil 73 is connected between the primary coil 72 and battery VA, while the other end thereof is connected to the terminal electrode 7 of the spark plug 1.

In addition, the igniter 75, being formed of a predetermined transistor, switches between supplying and shutting off power from the battery VA to the primary coil 72 in accordance with a communication signal input from an unshown predetermined electronic control unit (ECU). When applying a high voltage to the spark plug 1, after a magnetic field has been formed around the core 74 by causing current to flow from the battery VA to the primary coil 72, the communication signal from the ECU is switched from ON to OFF, thereby stopping the current from the battery VA to the primary coil 72. The magnetic field of the core 74 changes by the current stopping, and a primary voltage is generated in the primary coil 72 by a self-induction effect, while a high voltage (several to several tens of kV) of negative polarity is generated in the secondary coil 73, and the high voltage is applied to the spark plug 1 (terminal electrode 7).

Next, a detailed description will be given of an action of the heretofore described ignition system 101. Firstly, by turning off the communication signal from the ECU to the igniter 75 at a predetermined ignition timing, a high voltage of negative polarity is generated in the secondary coil 73 of the voltage application unit 71, and electrical energy is supplied to the gap 29 via the energizing portion 6 from the voltage application unit 71 (the electrical energy is continuously supplied for a certain time). Because of this, the spark plug 1 is charged with electrical charge, and the potential difference of the gap 29 increases. Then, when the potential difference of the gap 29 exceeds the breakdown voltage of the gap 29, the electrical charge with which the spark plug 1 is charged flows into the gap 29. As a result of this, a capacitive discharge occurs in the gap 29, and a large current flows through the gap 29.

As the resistance value of the gap 29 becomes very small when a capacitive discharge occurs, a condition is attained in which current easily flows from the voltage application unit 71 into the gap 29 but, as the spark plug 1 has the charge accumulation region (so to say, a capacitor) formed of the two conductive layers 31 and 32 and the insulator 2 (insulator nose length portion 13) sandwiched between them, the current from the voltage application unit 71 flows into the charge accumulation region, and is used for charging the charge accumulation region. As a result of this, as electrical charge flowing into the gap 29 decreases, a discharge path cannot be maintained, the resistance value of the gap 29 increases, an initial condition is returned again, and the spark plug 1 is charged again with electrical energy supplied from the voltage application unit 71.

Then, a capacitive discharge occurs in the gap 29 at a stage at which the potential difference of the gap 29 exceeds the breakdown voltage of the gap 29. Next, a charging of the spark plug 1 is repeatedly carried out while electrical energy is being supplied from the voltage application unit 71. As a result of this, plasma is generated in the spark plug 1 based only on power supplied from the voltage application unit 71.

As heretofore described in detail, according to the embodiment, the charge accumulation region formed in the spark plug 1 is such that the clearance C1 or the like is not interposed. Consequently, it is possible to dramatically increase the capacitance of the spark plug 1, and it is possible to accumulate a larger amount of electrical charge in the spark plug 1. As a result of this, it is possible to increase capacitive discharge current, and it is possible to improve plasma generation efficiency.

Also, the conductive layer 31 is provided on the insulator nose length portion 13 outer peripheral surface, small in thickness, of the insulator 2. Because of this, the charge accumulation region is formed in a condition in which the distance between the conductive layer 31 and center electrode 5 (conductive layer 32) is sufficiently small, and it is thus possible to still further increase the capacitance of the spark plug 1. Also, as the charge accumulation region is formed extremely near the gap 29, it is possible to effectively suppress a power loss when current flows from the charge accumulation region to the gap 29. Consequently, by these working effects acting synergistically, it is possible to further improve plasma generation efficiency, and it is possible to achieve a further improvement in ignitability.

In addition, the resistor 8, being provided closer to the axis CL1 direction rear end side than the conductive layers 31 and 32 (that is, the charge accumulation region), is configured in such a way that the resistor 8 does not exist on a power transmission path from the charge accumulation region to the gap 29. Consequently, it is possible to more reliably prevent a power loss when current flows from the charge accumulation region to the gap 29, while achieving effective noise suppression by providing the resistor 8.

Furthermore, as the electrical resistance value between the rear end of the energizing portion 6 and the leading end of the center electrode 5 via the resistor 8 is set to 1 kΩ or more, it is possible to increase the effectiveness of noise suppression. Meanwhile, as the electrical resistance value is set to 10 kΩ or less, it is possible to effectively suppress a power loss when power is transmitted from the voltage application unit 71 to the spark plug 1 (charge accumulation region). As a result of this, it is possible to more reliably increase capacitive discharge current.

Also, in the embodiment, a configuration is adopted such that the outer peripheral surface of the insulator 2 is exposed (that is, no conductive layer exists on the outer peripheral surface of the insulator 2) in the area AR. Consequently, it is possible to effectively prevent a situation in which a spark discharge occurs in a condition in which it is excessively pressed toward an outer circumference side, and it is possible to more reliably prevent a rapid progress of channeling. As a result of this, it is possible to more reliably prevent a rapid increase in the volume of the cavity portion 28, and it is possible to maintain superior ignitability over a long period.

Moreover, as the capacitance of the spark plug 1 is made sufficiently high at 25 pF or more, it is possible to more reliably increase capacitive discharge current, and it is possible to further improve plasma generation efficiency. Meanwhile, as the capacitance of the spark plug 1 is set to 100 pF or less, it is possible to effectively suppress an occurrence of channeling, and it is thus possible to maintain superior ignitability over a longer period.

Also, as the flange portion 5F is positioned closer to the axis CL1 rear end side than the tapered portion 22, it is possible to further increase the length of a region on the axial hole 4 positioned closer to the leading end side than the flange portion 5F. Consequently, it is possible to secure a larger length of the conductive layer 32 provided on the inner peripheral surface of the insulator 2, and it is possible to further increase the capacitance of the spark plug 1. As a result of this, it is possible to even further improve ignitability.

In addition, an ignition system of a common plasma jet spark plug includes a power supply unit for supplying power to the gap, in addition to a voltage application unit. In contrast, the ignition system 101 of the embodiment does not include a power supply unit, and has only the voltage application unit 71. An arrangement is adopted such that it is possible to generate plasma in the spark plug 1 based on only electrical energy supplied from the voltage application unit 71. Because of this, it is possible to achieve a drastic reduction in manufacturing costs and a reduction in the size of the ignition system 101.

Furthermore, with the ignition system having the voltage application unit and the power supply unit, it is necessary to provide a diode between the voltage application unit and the power supply unit in order to prevent current from flowing into one from the other of the two units. However, with the ignition system 101 of the embodiment, it is not necessary to provide a diode. Consequently, it is possible to prevent a situation in which energy input into the gap 29 decreases due to the existence of a diode, and it is possible to further improve ignitability. Also, providing no diode enables a further reduction in the size of the ignition system 101.

Figure 5:
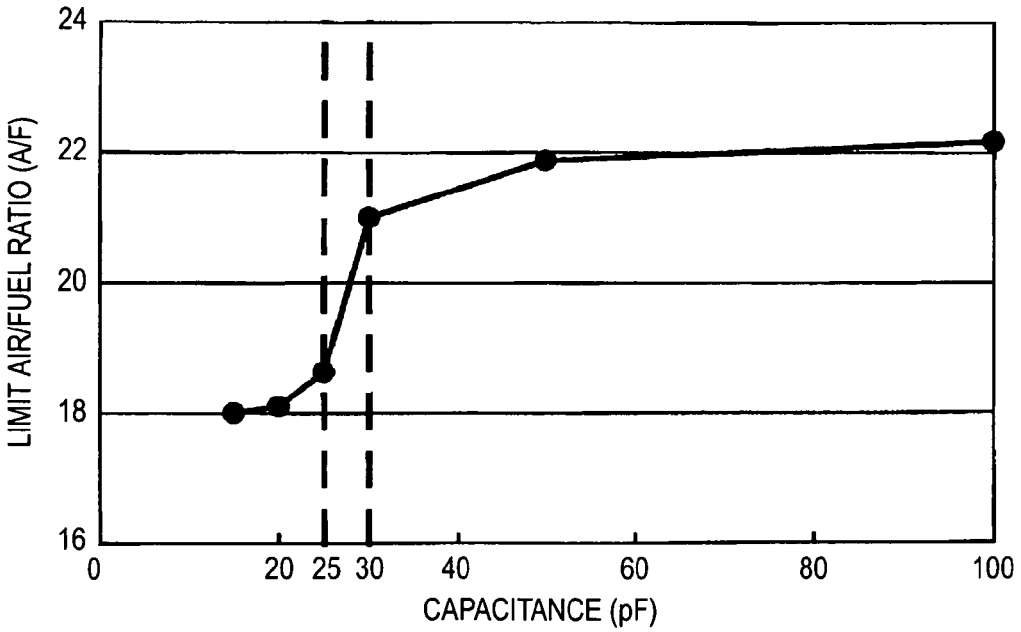
FIG. 5 is a graph showing results of an ignitability evaluation test on samples wherein capacitance is variously changed.

Next, in order to confirm the working effects achieved by the heretofore described embodiment, plural spark plug samples are fabricated whose capacitance is variously changed by changing the range of formation of the conductive layers, or the like, and an ignitability evaluation test is carried out on each sample. The outline of the ignitability evaluation test is as follows. That is, after each sample has been mounted in a four-cylinder engine of 2.0 L displacement, the engine is operated at a rate of 1600 rpm with an ignition timing as an MBT (an optimum spark position). Then, while an air/fuel ratio is being gradually increased (a fuel is being gradually made thinner), the coefficient of fluctuation of engine torque is measured for each air/fuel ratio, and an air/fuel ratio when the coefficient of fluctuation of engine torque exceeds 5% is specified as a limit air/fuel ratio. The higher the air/fuel ratio means the more superior the ignitability. Results of the test are shown in FIG. 5. The capacitance of the samples is specified by measuring the capacitance value between the center electrode and ground electrode.

It is confirmed, as shown in FIG. 5, that the samples with the capacitance set to 25 pF or more are very superior in ignitability as the limit air/fuel ratio increases dramatically. It is conceivable that this is because, by increasing the capacitance, capacitive discharge current is increased, and plasma generation efficiency is improved. Also, it is confirmed, in particular, that plasma generation efficiency improves dramatically by setting the capacitance to 30 pF or more.

Figure 6:
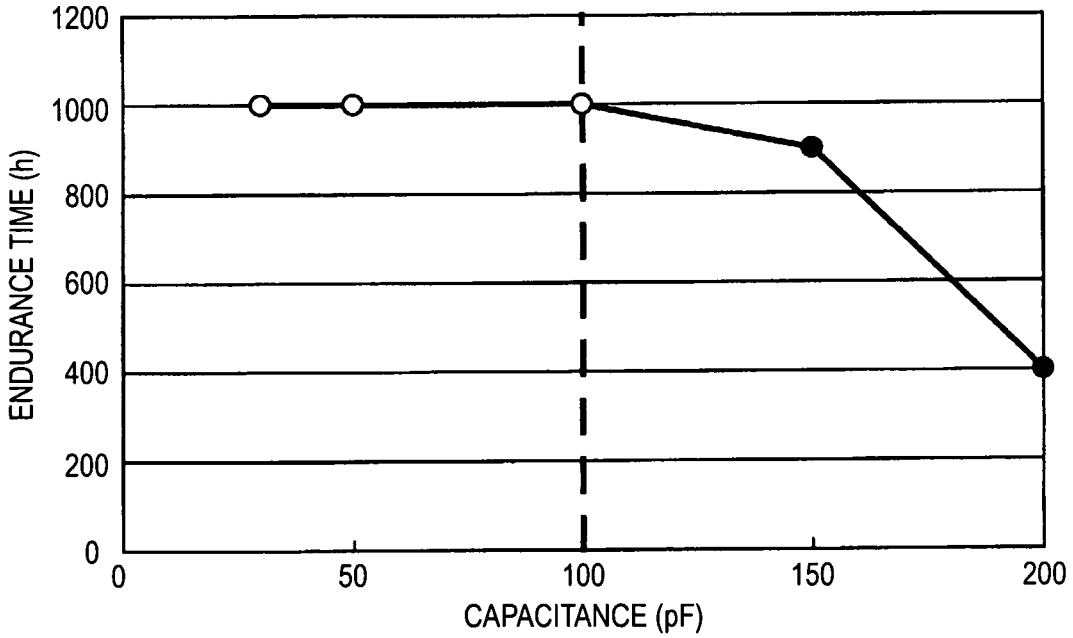
FIG. 6 is a graph showing results of an endurance evaluation test on samples wherein capacitance is variously changed.

Next, an endurance evaluation test is carried out on spark plug samples whose capacitance is variously changed. The outline of the endurance evaluation test is as follows. Plasma is emitted by supplying power to each sample, the emitted plasma is imaged from the side surface side of the samples, and the area of emission of plasma in the initial condition is measured from the imaged image. After that, after the samples have been mounted in a predetermined chamber, the pressure in the chamber is set to 0.4 MPa, and each sample is discharged at an applied voltage frequency of 60 Hz (that is, at a rate of 3600 times per minute). Next, plasma is emitted by supplying power to the samples each time 100 hours elapse, the emitted plasma is imaged from the side surface side of the spark plugs, and the area of emission of plasma is measured from the imaged image. Then, a time (an endurance time) in which the measured area of emission of plasma is reduced to a half or less with respect to the area of emission of plasma in the initial condition is specified. Results of the test are shown in FIG. 6. A time for which a voltage is applied to each sample is set to a maximum of 1000 hours. Also, in FIG. 6, test results of samples wherein the area of emission of plasma measured at the stage of 1000 hours is larger than half of the area of emission of plasma in the initial condition are indicated by blank circles.

It is revealed, as shown in FIG. 6, that the samples with the capacitance to 100 pF or less can maintain superior ignitability over a long period as the endurance time exceeds 1000 hours. It is conceivable that this is because an excessive increase in discharge energy is suppressed, and it is difficult for wear (channeling) of the insulator to occur.

According to the heretofore described test results, it can be said that it is preferable, in order to maintain superior ignitability over a long period while achieving an improvement in ignitability, to set the capacitance of the spark plug to 25 pF or more and 100 pF or less. Also, it can be said that it is preferable, from the standpoint of achieving a further improvement in ignitability, to set the capacitance of the spark plug to 30 pF or more.

Figure 7:
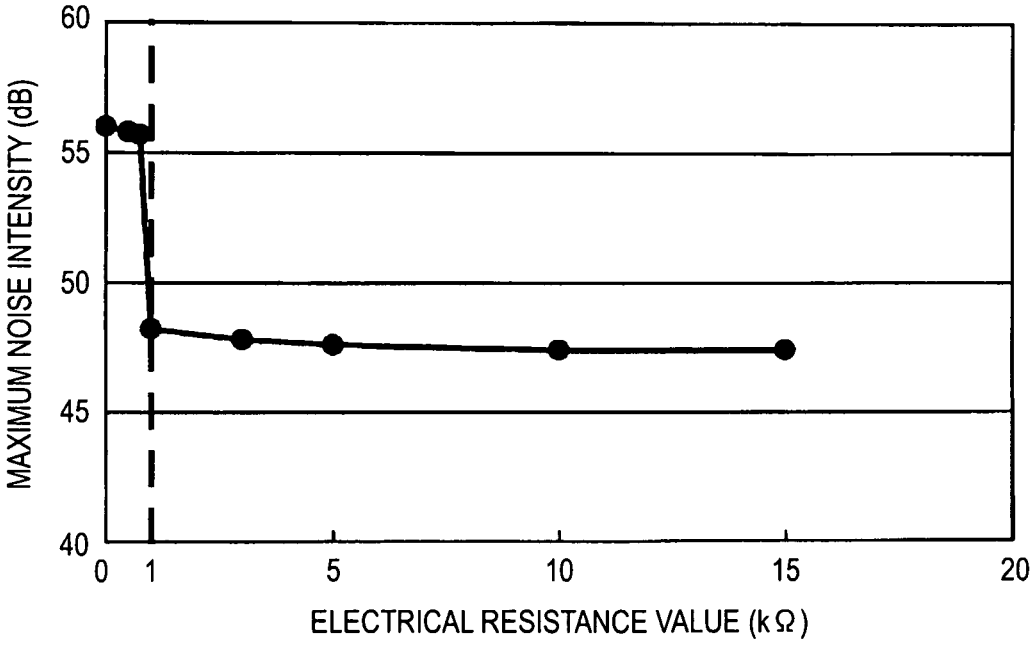
FIG. 7 is a graph showing results of a noise evaluation test on samples wherein an electrical resistance value between the rear end of an energizing portion and the leading end of a center electrode via a resistor is variously changed.
Figure 8:
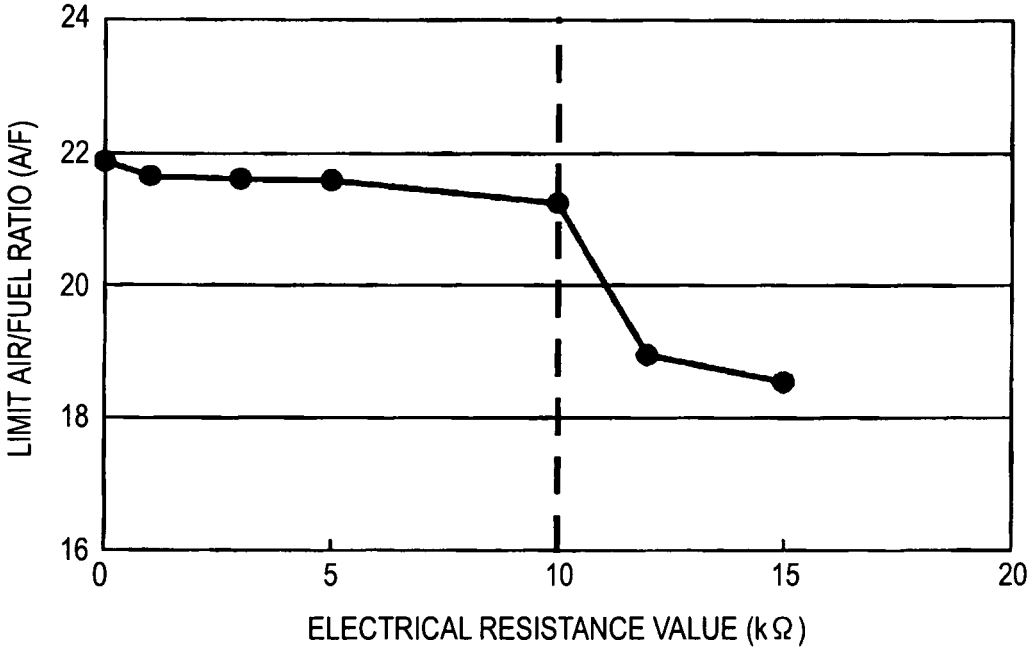
FIG. 8 is a graph showing results of the ignitability evaluation test on samples wherein an electrical resistance value between the rear end of the energizing portion and the leading end of the center electrode via the resistor is variously changed.

Next, there are fabricated plural spark plug samples wherein the electrical resistance value between the rear end of the energizing portion and the leading end of the center electrode via the resistor is variously changed, and a noise evaluation test and the ignitability evaluation test are carried out on each sample. The outline of the noise evaluation test is as follows. That is, the samples are discharged within a measurement range of 30 to 1000 MHz using a predetermined EMI measurement device (by SCHAFFNER, GTEM-LT 550), and the maximum value of a noise intensity (a maximum noise intensity) occurring at that time is measured for each sample. Results of the noise evaluation test are shown in FIG. 7, and results of the ignitability evaluation test are shown in FIG. 8. In the ignitability evaluation test, the capacitance of each sample is set to 50 pF.

It is found, as shown in FIG. 7, that the samples with the electrical resistance value set to 1 kΩ or more have a superior effectiveness of noise suppression as the maximum noise intensity is less than 50 dB.

Meanwhile, it is confirmed, as shown in FIG. 8, that the samples with the electrical resistance value set to 10 kΩ or less are superior in ignitability as the limit air/fuel ratio exceeds 20. It is conceivable that this is because a power loss is effectively suppressed when power is transmitted from the voltage application unit to the spark plug, and capacitive discharge current further increases.

According to the heretofore described test results, it can be said that it is preferable, in order to sufficiently achieve the effectiveness of suppression of noise while maintaining superior ignitability, to set the electrical resistance value between the rear end of the energizing portion and the leading end of the center electrode via the resistor to 1 kΩ or more and 10 kΩ or less.

The invention, not being limited to the contents described in the heretofore described embodiment, may be implemented in, for example, the following ways. It goes without saying that other applications and modification examples which are not illustrated below are also possible as a matter of course.

Figure 9A:
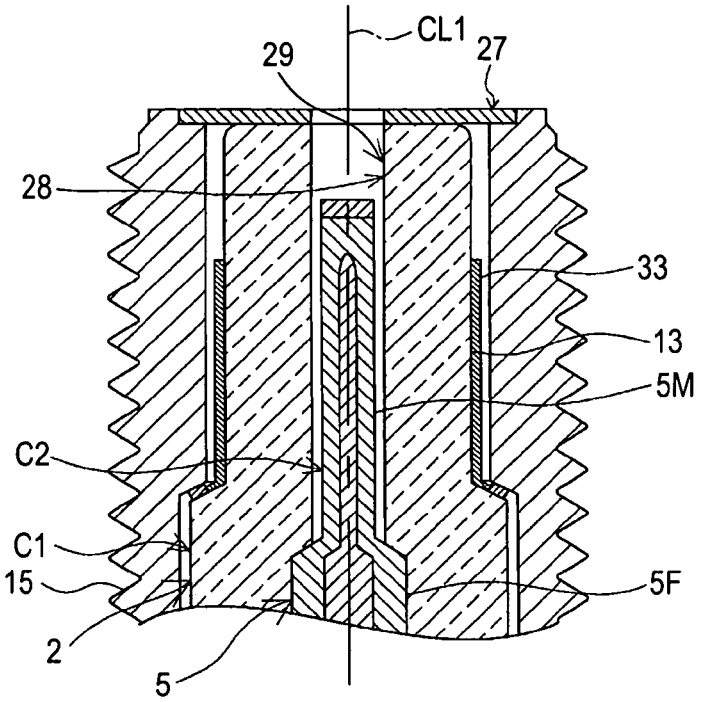
FIGS. 9A and 9B are partially enlarged sectional views showing configurations of conductive layers in another embodiment.
Figure 9B:
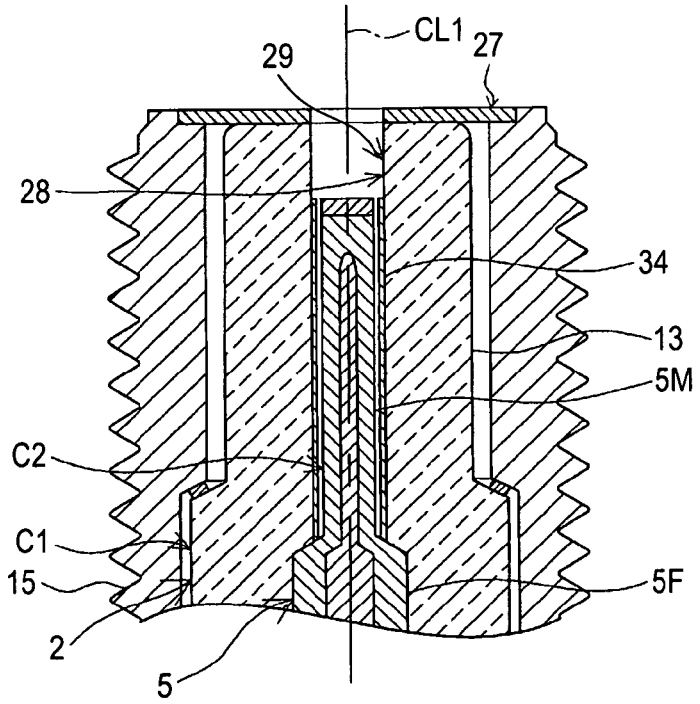
Figure 10:
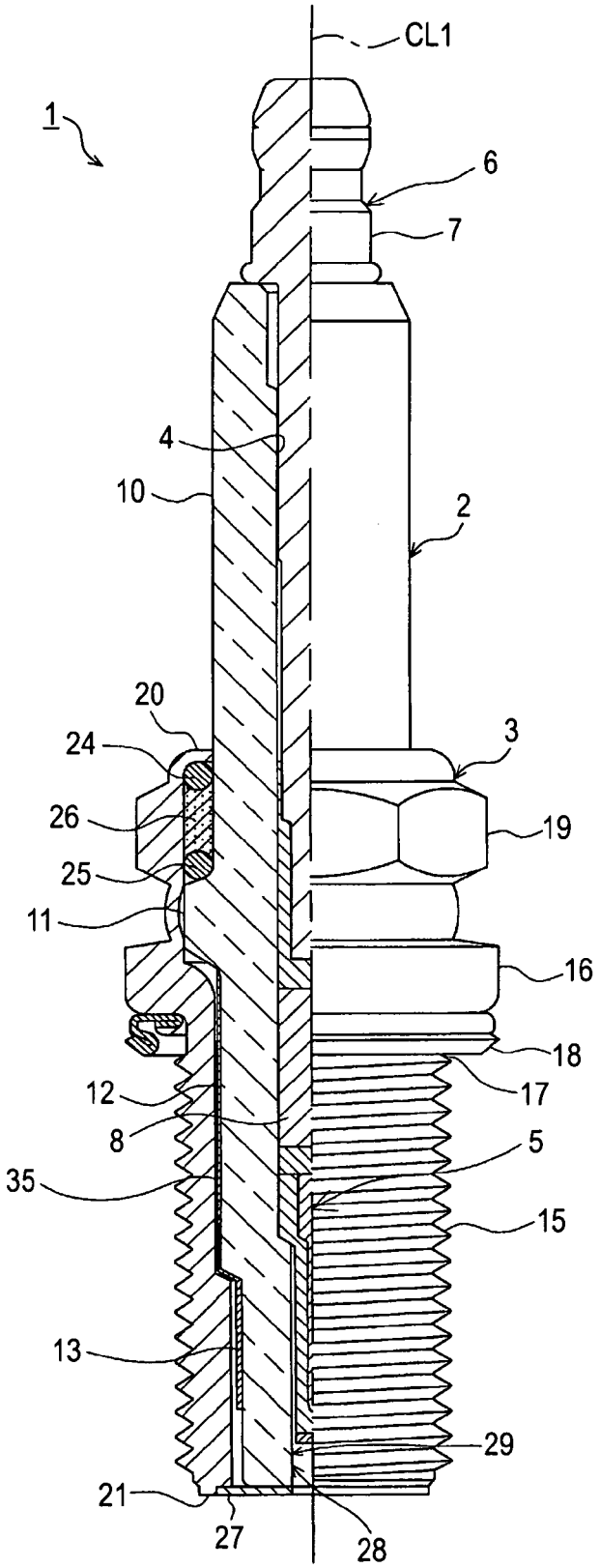
FIG. 10 is a partially enlarged sectional view showing a configuration of a conductive layer in another embodiment.

(a) In the heretofore described embodiment, the conductive layers 31 and 32 are respectively provided on the outer peripheral surface and the inner peripheral surface of the insulator 2. However, a conductive layer 33 may be provided on only the outer peripheral surface of insulator 2 or a conductive layer 34 may be provided on only the inner peripheral surface of the insulator 2, as respectively shown in FIGS. 9A and 9B. When providing a conductive layer on only the outer peripheral surface of the insulator 2, it is sufficient that the conductive layer is provided on at least one portion of a surface on the insulator 2 outer peripheral surface opposed to the inner peripheral surface of the metal shell 3. When providing a conductive layer on only the inner peripheral surface of the insulator 2, it is sufficient that the conductive layer is provided on at least one portion of a surface on the insulator 2 inner peripheral surface opposed to the outer peripheral surface of the center electrode 5. Consequently, for example, as shown in FIG. 10, a conductive layer 35 may be provided from the middle barrel portion 12 to the insulator nose length portion 13 of the insulator 2.

Figure 11:
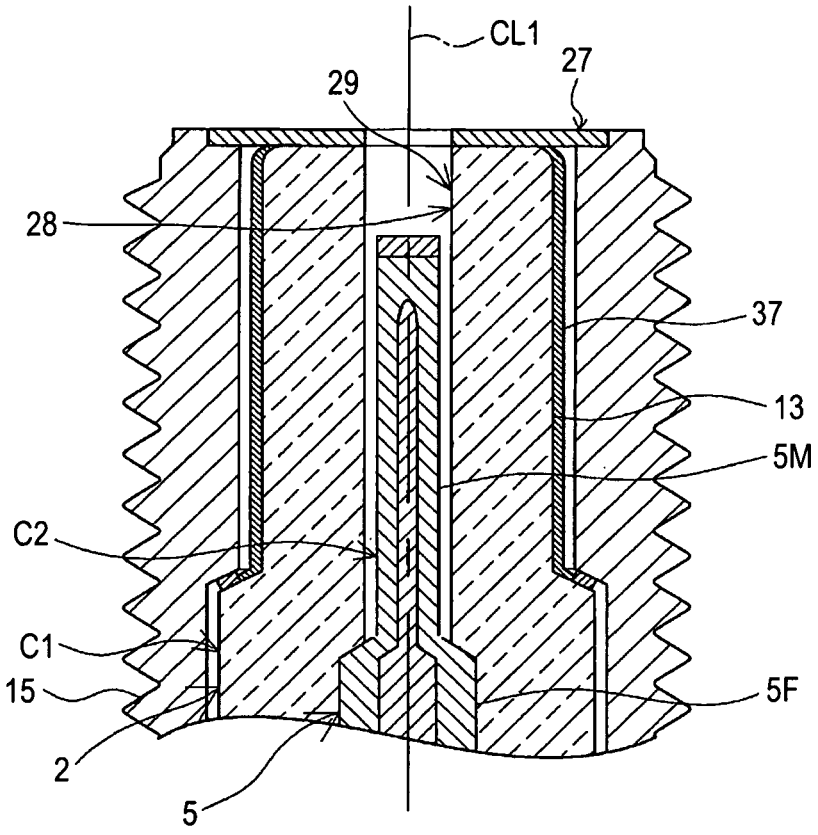
FIG. 11 is a partially enlarged sectional view showing a configuration of a conductive layer in another embodiment.

(b) In the heretofore described embodiment, the conductive layer 31 is not provided on the leading end side of the insulator nose length portion 13, but a conductive layer 37 may be provided all over the insulator nose length portion 13, as shown in FIG. 11.

Figure 12:
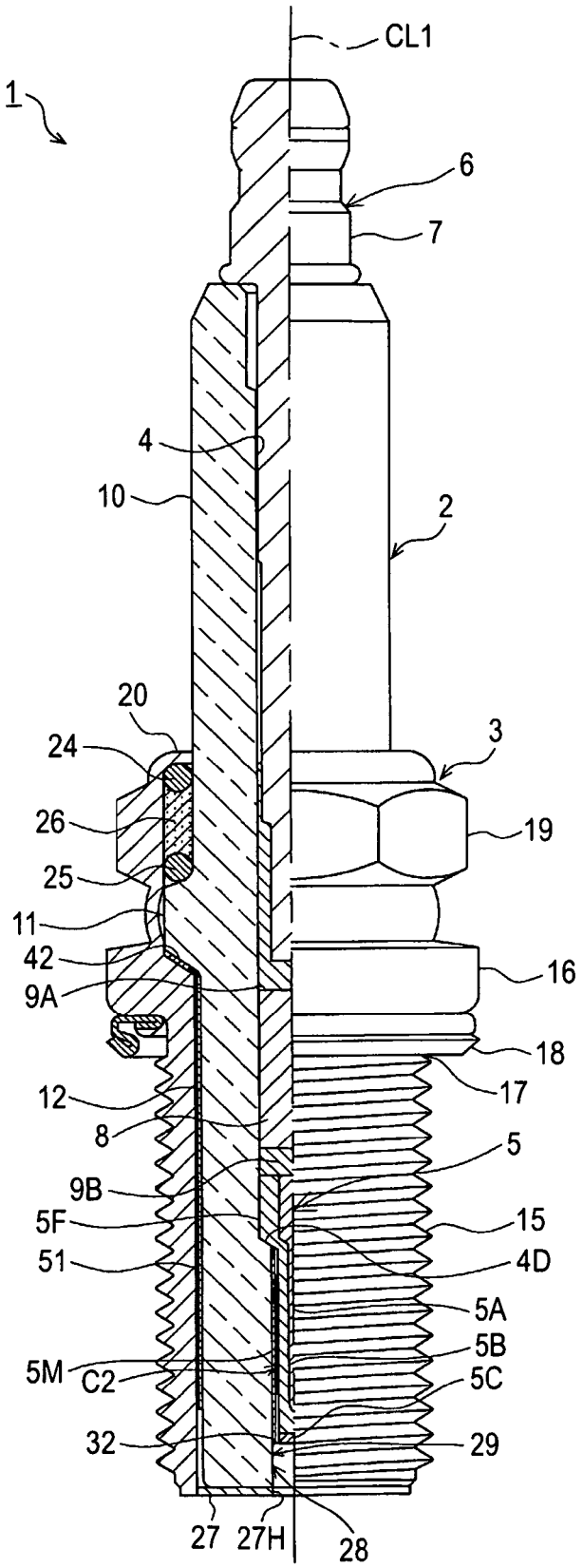
FIG. 12 is a partially sectioned front view showing a configuration of a spark plug in another embodiment.

(c) In the heretofore described embodiment, a configuration is adopted such that the decreasing diameter portion 14, acting as the shoulder, provided on the leading end side of the insulator 2 is retained by the tapered portion 22, acting as the retained portion, provided on the leading end side of the metal shell 3. As opposed to this, a configuration may be adopted such that the large diameter portion 11 acting as a protuberance is retained directly or indirectly by a shelf portion 42, acting as a retained portion, which is provided closer to the rear end side than the leading end side end face of the seat 16 of the metal shell 3, and whose inside diameter decreases gradually toward the axis CL1 direction leading end side, as shown in FIG. 12 (in FIG. 12, the leading end side end face of the large diameter portion 11 is retained indirectly by the shelf portion 42 across a plate packing). That is, a configuration may be adopted such that a region of the insulator 2 retained on the metal shell 3 is positioned closer to the axis CL1 direction rear end side than the leading end side end face of the seat 16. Then, a conductive layer 51 may be provided on at least one portion of the outer peripheral surface of a region of the insulator 2 which extends from the leading end of the large diameter portion 11 to the axis CL1 direction leading end side. In this case, as well as it being possible to increase the area of the conductive layer 51, it is possible to limit the interposition of the clearance in the charge accumulation region over a wider area, and it is possible to further increase the capacitance of the spark plug 1. As a result of this, it is possible to achieve a further improvement in plasma generation efficiency, and it is possible to further improve ignitability.

(d) In the heretofore described embodiment, the ground electrode 27 is formed from a metal such as W or Ir, but only an inner peripheral side region of the ground electrode 27 which wears out as a result of a spark discharge may be formed from a metal such as W or Ir.

(e) In the heretofore described embodiment, the electrode tip 5C is provided in the leading end portion of the center electrode 5, but the center electrode 5 may be configured without providing the electrode tip 5C.

DESCRIPTION OF REFERENCE NUMERALS AND SIGNS

1 Spark plug (plasma jet spark plug)
2 Insulator (insulating body)
3 Metal shell
4 Axial hole
5 Center electrode
5F Flange portion
6 Energizing portion
8 Resistor
13 Insulator nose length portion
14 Decreasing diameter portion (shoulder)
15 Threaded portion
16 Seat
22 Tapered portion (retained portion)
27 Ground electrode
28 Cavity portion
29 Gap
31 Conductive layer (first conductive layer)
32 Conductive layer (second conductive layer)
42 Shelf portion (retained portion)
71 Voltage application unit
101 Ignition system
CL1 Axis Having described the invention, the following is claimed:

1. A plasma jet spark plug, comprising:

an insulating body having an axial hole extending in a direction of an axis;

a center electrode inserted on a leading end side of the axial hole so that a leading end face of the center electrode is positioned closer to a rear end side of the spark plug in the axis direction than a leading end of the insulating body;

a metal shell disposed on an outer periphery of the insulating body, a ground electrode, fixed in a leading end portion of the metal shell, which is disposed closer to a leading end side of the spark plug in the axis direction than the leading end of the insulating body, a cavity portion formed by an inner peripheral surface of the insulating body and the leading end face of the center electrode, at least one conductive layer formed from a conductive material provided on at least one portion of at least one of (a) a part of an outer peripheral surface of the insulating body which is opposed to an inner peripheral surface of the metal shell, the conductive layer electrically connected to the ground electrode and (b) a part of the inner peripheral surface of the insulating body which is opposed to an outer peripheral surface of the center electrode, the conductive layer electrically connected to the center electrode.

2. The plasma jet spark plug according to claim 1, wherein the insulating body includes:

a shoulder retained directly or indirectly on the inner peripheral surface of the metal shell; and an insulator nose portion extending from a leading end of the shoulder to the leading end side of the spark plug in the axis direction, wherein the conductive layer is provided on at least one portion of an outer peripheral surface of the insulator nose portion.

3. The plasma jet spark plug according to claim 1, wherein the insulating body includes a protuberance retained directly or indirectly on the inner peripheral surface of the metal shell, and the metal shell includes:

a mounting threaded portion formed on a leading end side outer periphery of the metal shell; and a seat, formed closer to a rear end side of the metal shell than the threaded portion, which extends outward in a radial direction, wherein the conductive layer is provided in at least one portion of a region of the outer peripheral surface of the insulating body, closer to the leading end side of the spark plug than the protuberance, and the protuberance is positioned closer to the rear end side of the spark plug in the axis direction than a leading end side end face of the seat.

4. The plasma jet spark plug according to claim 1, wherein a conductive energizing portion connected to a rear end portion of the center electrode is inserted in the axial hole, and a resistor is disposed in a region of the energizing portion closer to the rear end side of the spark plug in the axis direction than the conductive layers.

5. The plasma jet spark plug according to claim 4, wherein an electrical resistance value between a rear end of the energizing portion and a leading end of the center electrode via the resistor is set to 1 kΩ or more and 10 kΩ or less.

6. The plasma jet spark plug according to claim 1, wherein the outer peripheral surface of the insulating body is exposed in an area along the axis from the leading end of the center electrode to a position 1 mm toward the rear end side of the spark plug.

7. The plasma jet spark plug according to claim 1, wherein the capacitance of the spark plug is set to 25 pF or more and 100 pF or less.

8. The plasma jet spark plug according to claim 1, wherein the center electrode includes a flange portion, protruding outward in the radial direction, which is retained on the inner peripheral surface of the insulating body, and the metal shell includes a retained portion by which the outer peripheral surface of the insulating body is retained directly or indirectly, wherein the conductive layer is provided in at least one portion of a region of the insulating body inner peripheral surface positioned closer to the leading end side of the spark plug than the flange portion, and the flange portion is positioned closer to the rear end side of the spark plug in the axis direction than the retained portion.

9. An ignition system, comprising:

a plasma jet spark plug, comprising:

an insulating body having an axial hole extending in a direction of an axis;

a center electrode inserted on a leading end side of the axial hole so that a leading end face of the center electrode is positioned closer to a rear end side of the spark plug in the axis direction than a leading end of the insulating body;

a metal shell disposed on an outer periphery of the insulating body, a ground electrode, fixed in a leading end portion of the metal shell, which is disposed closer to a leading end side of the spark plug in the axis direction than the leading end of the insulating body, a cavity portion formed by an inner peripheral surface of the insulating body and the leading end face of the center electrode, at least one conductive layer formed from a conductive material provided on at least one portion of at least one of (a) a part of an outer peripheral, surface of the insulating body which is opposed to an inner peripheral surface of the metal shell, the conductive layer electrically connected to the ground electrode and (b) a part of an inner peripheral surface of the insulating body which is opposed to an outer peripheral surface of the center electrode, the conductive layer electrically connected to the center electrode, a conductive energizing portion connected to a rear end portion of the center electrode is inserted in the axial hole, and a resistor is disposed in a region of the energizing portion closer to the rear end side of the spark plug in the axis direction than the conductive layers; and a voltage application unit which applies a voltage via the energizing portion to a gap formed between the center electrode and ground electrode.

* * * * *